US007287520B2

(12) United States Patent
Hashimoto et al.

(10) Patent No.: US 7,287,520 B2
(45) Date of Patent: Oct. 30, 2007

(54) APPARATUS FOR ENHANCING COMBUSTION EFFICIENCY OF LIQUID FUEL

(75) Inventors: Kenichi Hashimoto, 5-5-31-910, Nankonaka, Suminoe-ku, Osaka-shi, Osaka (JP) 559-0033; Hirofumi Nakagawa, Osaka (JP)

(73) Assignee: Kenichi Hashimoto, Osaka (JP)

( * ) Notice: Subject to any disclaimer, the term of this patent is extended or adjusted under 35 U.S.C. 154(b) by 108 days.

(21) Appl. No.: 10/523,013

(22) PCT Filed: Jul. 30, 2003

(86) PCT No.: PCT/JP03/09715

§ 371 (c)(1),
(2), (4) Date: Feb. 1, 2005

(87) PCT Pub. No.: WO2004/018938

PCT Pub. Date: Mar. 4, 2004

(65) Prior Publication Data

US 2005/0241626 A1 Nov. 3, 2005

(30) Foreign Application Priority Data

Aug. 1, 2002 (JP) ..... 2002-224887

(51) Int. Cl.
*F02M 27/00* (2006.01)

(52) U.S. Cl. ..... 123/538

(58) Field of Classification Search ..... 123/536–538
See application file for complete search history.

(56) References Cited

U.S. PATENT DOCUMENTS

| | | | | |
|---|---|---|---|---|
| 5,108,618 | A * | 4/1992 | Hirasawa | 210/689 |
| 5,460,144 | A | 10/1995 | Park | |
| 5,632,254 | A * | 5/1997 | Kim | 123/538 |
| 6,012,915 | A * | 1/2000 | Mori et al. | 431/4 |

FOREIGN PATENT DOCUMENTS

| | | | |
|---|---|---|---|
| JP | 5-157220 | | 6/1993 |
| JP | 7-174017 | | 7/1995 |
| JP | 410046162 | A * | 2/1998 |
| JP | 410047173 | A * | 2/1998 |
| JP | 02001221109 | A * | 8/2001 |
| JP | 2002-263655 | | 9/2002 |
| JP | 2003161152 | A * | 6/2003 |

* cited by examiner

*Primary Examiner*—Marguerite McMahon
(74) *Attorney, Agent, or Firm*—Wenderoth, Lind & Ponack, L.L.P.

(57) ABSTRACT

A high combustion efficiency device for liquid fuel comprises a hollow member made of electrically conductive material, liquid filling the hollow member and tourmaline particles dispersed in the liquid, wherein the high combustion efficiency device is formed to be attachable to at least one of a fuel tank for liquid fuel and a fuel passage extending from the fuel tank to a combustion device of the liquid fuel.

26 Claims, 8 Drawing Sheets

APPARATUS FOR ENHANCING COMBUSTION EFFICIENCY OF LIQUID FUEL

TECHNICAL FIELD

The present invention relates to a high combustion efficiency device for liquid fuel.

BACKGROUND ART

The exhaust gas from automobiles contains environmental pollutants including unburned matter such as CO (carbon monoxide) and HC (hydrocarbon), and NOx (nitrogen oxide), or the like.

In an automobile, as disclosed in Japanese Unexamined Patent Application No. Hei-7-174017, catalysts for removing unburned matter such as CO and HC, and NOx are provided in an exhaust gas conduit for preventing the unburned matter such as CO and HC, and NOx from being discharged into the atmospheric air.

However, the catalysts are degraded due to use for a long period of time, and thus, the efficiency for removing the unburned matter such as CO and HC, and NOx is lowered. Therefore, it is not possible to stably remove the unburned matter such as CO and HC, and NOx. Further, since the degraded catalysts need to be replaced periodically, maintenance cost for replacement operation is required.

DISCLOSURE OF THE INVENTION

The present invention has been made taking the above circumstances into account, and an object of the present invention is to provide a high combustion efficiency device for liquid fuel in which almost no maintenance cost is required, combustion efficiency of liquid fuel in an engine portion is improved, the amount of unburned matter is reduced as much as possible, and generation of nitrogen oxide is suppressed.

In order to achieve the object, a high combustion efficiency device for liquid fuel according to the present invention (herein after referred to as the "high combustion efficiency device") is characterized in that at least tourmaline particles are filled in a hollow member made of electrically conductive material, while the tourmaline particles are electrically connected to the hollow member.

The high combustion efficiency device according to the present invention may be configured such that the high combustion efficiency device is attachable to at least part of a fuel passage extending from a fuel tank of the liquid fuel to a combustion device of the liquid fuel, the high combustion efficiency device can be formed to surround a fuel pipe, and the high combustion efficiency device comprises adsorption means attached to an inner wall surface of the fuel tank, a device body, and a float which allows the device body to float in the fuel in the fuel tank. Further, the high combustion efficiency device according to the present invention may be configured such that the surface of the hollow member is covered by a far-infrared ray generating substance.

In the present invention, the electrically conductive substance of the hollow member is preferably, but not particularly, limited to highly electrically conductive, and light material such as aluminum.

Further, if the high combustion efficiency device surrounds the fuel pipe, it is preferable that a far-infrared ray reflection layer is provided as the outermost layer.

It is preferable that the far-infrared ray generating substance is hard alumite.

Further, it is preferable that the high combustion efficiency device according to the present invention is mounted while the hollow member is grounded.

The tourmaline is a crystalline body having a propensity to naturally generate plus polarity on one side, and minus polarity on the other side. The tourmaline includes, e.g., Schorl tourmaline ($NaFe_3Al_6(BO_3)_3Si_6O_{18}(OH)_4$), Dravite tourmaline ($NaMg_3Al_6(BO_3)_3Si_6O_{18}(OH)_4$), Elbaite tourmaline ($Na(Li,Al)_3Al_6(BO_3)_3Si_6O_{18}(OH)_4$), Liddicoatite tourmaline ($Ca(Li,Al)_3Al_6(BO_3)_3Si_6O_{18}(O,OH,F)_4$), and Uvite tourmaline ($(Ca,Na)(Mg,Fe)_3Al_5Mg(BO_3)_3Si_6O_{18}(OH,F)_4$).

Though it may be possible to use only tourmaline particles, for example, it is preferable that the tourmaline particles are dispersed, and mixed in an electrically conductive solution or electrically conductive gel containing carbon graphite particles.

The electrically conductive solution or the electrically conductive gel is not particularly limited as long as it is not corrosive to the hollow member, and highly electrically conductive. Further, it is possible to use silicone oil or machine oil as the dispersion liquid.

Further, a dispersion agent such as a surface active agent may be added into the solution. The surface active agent is not particularly limited as long as it allows for uniform dispersion of the tourmaline particles. It is preferable that the surface active agent is a nonionic agent.

The particle size of the tourmaline particles and the carbon graphite particles is not particularly limited. Preferably, the particle size is 10μ or less, and more preferably, the particle size is 5μ or less.

The proportion of mixing the tourmaline particles and the carbon graphite particles is not particularly limited. It is preferable that the proportion is within a range between about 100:1 and 20:1.

The far-infrared ray generating substance is not particularly limited. For example, a ceramic such as hard alumite is chiefly used as the far-infrared ray generating substance.

The far-infrared ray reflection layer may be provided integrally on the surface of the hollow member. However, typically, the far-infrared ray reflection layer is a far-infrared ray reflection sheet separated from the hollow member, and the far-infrared ray reflection sheet surrounds the hollow member.

The far-infrared ray reflection sheet is not particularly limited as long as it can reflect the far-infrared rays. For example, the far-infrared ray reflection sheet is a metallic foil such as an aluminum foil or a resinous composition sheet comprising polyethylene terephthalate containing ultrafine powder of Indium Tin Oxide (ECOSHADE manufactured by Mitsubishi Material Corporation).

The adsorption (attachment) means is not particularly limited. For example, a permanent magnet or a sucking disk is used as the adsorption means, and the permanent magnet is preferably used as the adsorption means.

The float may be formed integrally with the device body. Alternatively, the device body may be hung from the float.

Since the high combustion efficiency device for liquid fuel according to the present invention has the structure as described above, almost no maintenance cost is required, combustion efficiency of liquid fuel in an engine portion is improved, the amount of unburned matter is reduced as much as possible, and generation of nitrogen oxide is suppressed.

Further, if the surface of the hollow member is covered by the far-infrared ray generating substance such as hard alumite, the hollow member is used in a grounded condition, or the far-infrared ray reflection layer is provided as the outermost layer, radiation amount of the far-infrared rays is increased, and thus, the high combustion efficiency device is compact, and has a high performance.

Further, if the tourmaline particles are dispersed and mixed in the electrically conductive solution or the electrically conductive gel containing the carbon graphite particles, it is possible to stabilize the amount of the far-infrared rays emitted from the tourmaline.

DETAILED DESCRIPTION OF THE INVENTION

Hereinafter, the present invention will be described in detail with reference to the drawings showing embodiments of the present invention.

Figure 1:
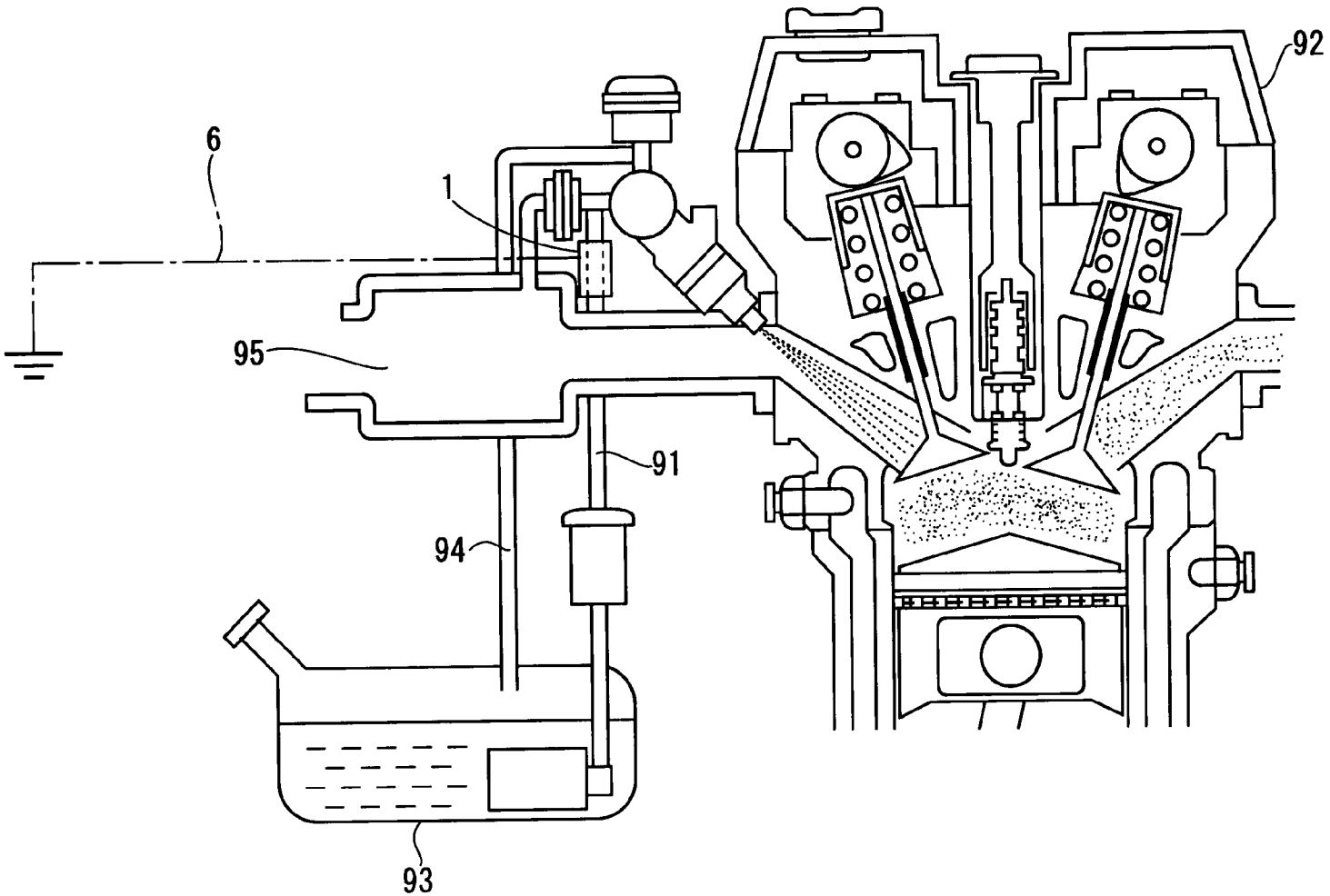
FIG. 1 is a view of a high combustion efficiency device according to a first embodiment of the present invention, schematically showing an example in which the high combustion efficiency device is used.
Figure 2:
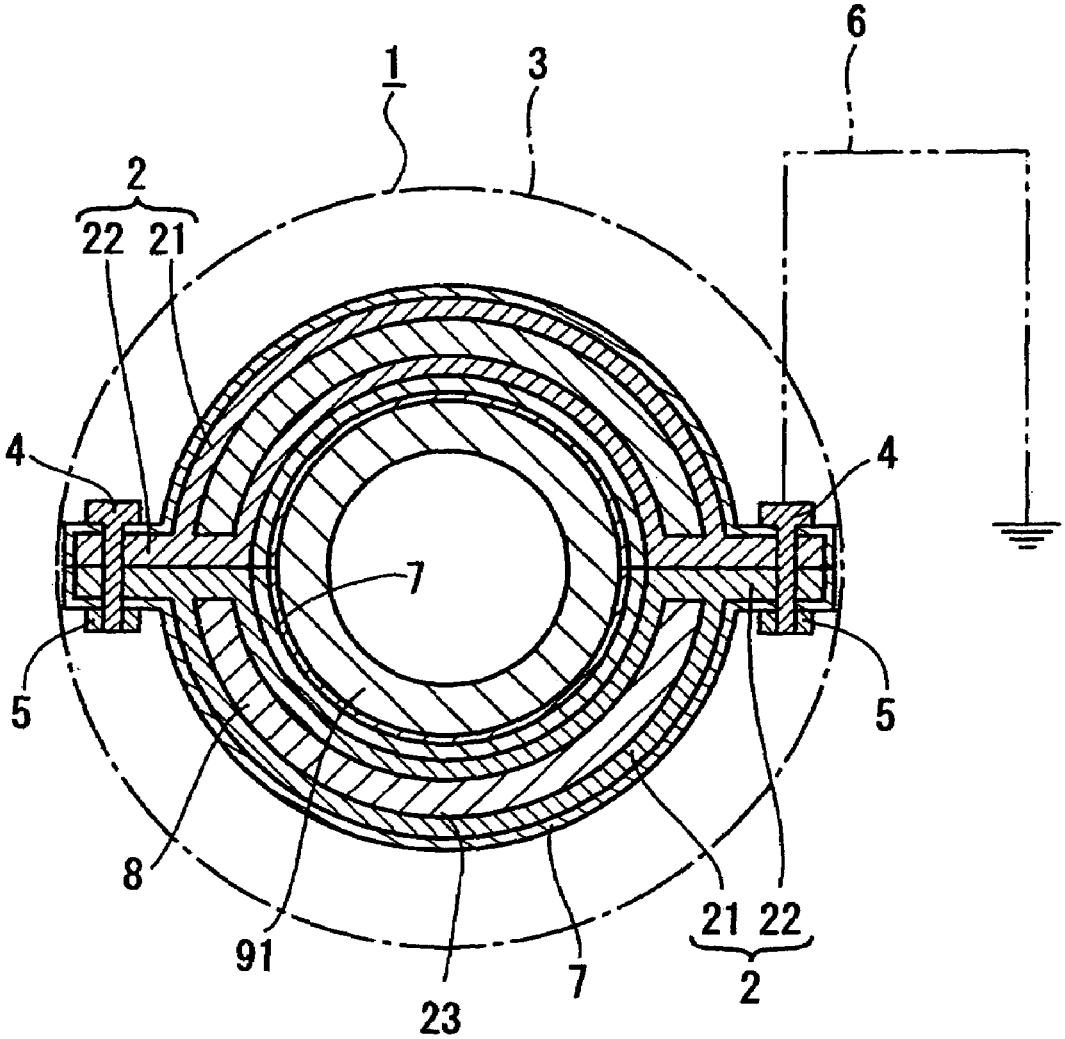
FIG. 2 is a cross sectional view of a portion of the high combustion efficiency device in FIG. 1.

FIG. 1 and FIG. 2 show a high combustion efficiency device for liquid fuel according to a first embodiment of the present invention.

As shown in FIG. 1 and FIG. 2, the high combustion efficiency device 1 includes two hollow members 2, a far-infrared ray reflection sheet 3 as a far-infrared ray reflection layer, a bolt 4, a nut 5, and a ground wire 6.

Each of the hollow members 2 is made of aluminum, and includes a semi-cylindrical body 21 and a flange 22 extending on both sides of the body 21. The outer circumferential surface and the inner circumferential surface of the body 21 and the outer wall surface of the flange 22 are covered by a hard alumite layer 7 as a far-infrared ray generating substance formed by anodic oxidation.

Further, the body 21 has a hollow structure having an internal space 23, and electrically conductive solution 8 is filled in the internal space 23. Tourmaline particles and carbon graphite particles are dispersed in the electrically conductive solution 8. The tourmaline particles are electrically conducted to the hollow members 2 via the electrically conductive solution 8.

As shown in FIG. 2, the flanges 22 of the two hollow members 2 abut against each other. The bolt 4 is inserted through screw insertion holes of the flanges 22 from one of the hollow members 2. A tip end of the bolt 4 is screwed into the nut 5 on the side of the other hollow member 2 to combine the two bodies 21 into a single cylindrical high combustion efficiency device body 21 having substantially the same diameter as that of a rubber fuel pipe 91 of an automobile as described later.

The far-infrared ray reflection sheet 3 is formed into a size that can surround the high combustion efficiency device body 21.

One end of the ground wire 6 is connected to the bolt 4. Although not shown, a connection terminal is provided on the other end.

In the high combustion efficiency device 1, first, the high combustion efficiency device body 21 is disassembled in advance, and a portion of the rubber fuel pipe 91 near the engine 92 is set in the cylinder formed by the bodies 21 of the two hollow members 2. The two hollow members 2 are combined together by the bolt 4 and the nut 5. That is, the portion of the fuel pipe 91 near the engine 92 is surrounded by the high combustion efficiency device body 21.

Next, the connection terminal of the ground wire 6 is connected to a minus terminal of a battery (not shown) of the automobile, and the hollow members 2 are grounded. Then, the high combustion efficiency device body 21 is surrounded by a far-infrared ray reflection sheet 3. Thus, the high combustion efficiency device body 21 is set in an engine compartment of the automobile.

The high combustion efficiency device 1 has the structure as described above. Therefore, the electromagnetic waves such as the far-infrared rays generated by the tourmaline particles filled in the hollow members 2 is radiated through the fuel pipe to the liquid fuel such as gasoline or light oil in the fuel pipe. The electromagnetic wave affects hydrocarbon molecules so that each of the hydrocarbon molecules is combusted easily (oxygen can attack easily).

Therefore, the liquid fuel supplied to the engine 92 is combusted swiftly and completely in the engine 92 in comparison with the case in which the high combustion efficiency device 1 is not mounted. Therefore, the exhaust gas contains almost no CO and HC.

Further, since the liquid fuel is combusted almost completely in the engine 92, the exhaust gas is not further combusted in the exhaust pipe. Therefore, temperature in the exhaust pipe is kept at a low level, and it is possible to suppress generation of NOx which is generated easily at high temperatures.

Further, since the surface of the hollow member 2 is covered by hard alumite which is the far-infrared ray generating substance, in comparison with the case in which only the tourmaline particles are used, the amount of far-infrared rays is increased. Further, since the far-infrared ray reflection layer formed by the surrounding far-infrared ray reflection sheet 3 is provided at the outermost position, the far-infrared rays directed toward the outside are reflected by the far-infrared ray reflection layer, and directed toward the fuel pipe 91. Thus, it is possible to radiate the far-infrared rays efficiently to the liquid fuel.

Further, since the hollow members 2 are connected to the ground via the ground wire 6, polarization of the tourmaline is always placed in a stable condition. Thus, the far-infrared rays can be generated semi-permanently.

Further, since the tourmaline particles do not directly contact the liquid fuel, it is possible to supply the far-infrared rays semi-permanently without any degradation of the tourmaline particles. Thus, almost no maintenance cost is required. Further, thanks to the simple structure and small fabrication cost, the initial cost is not significant.

In FIG. 1, reference numeral 93 denotes a fuel tank, reference numeral 94 denotes a return pipe, and reference numeral 95 denotes a surge tank.

Figure 3:
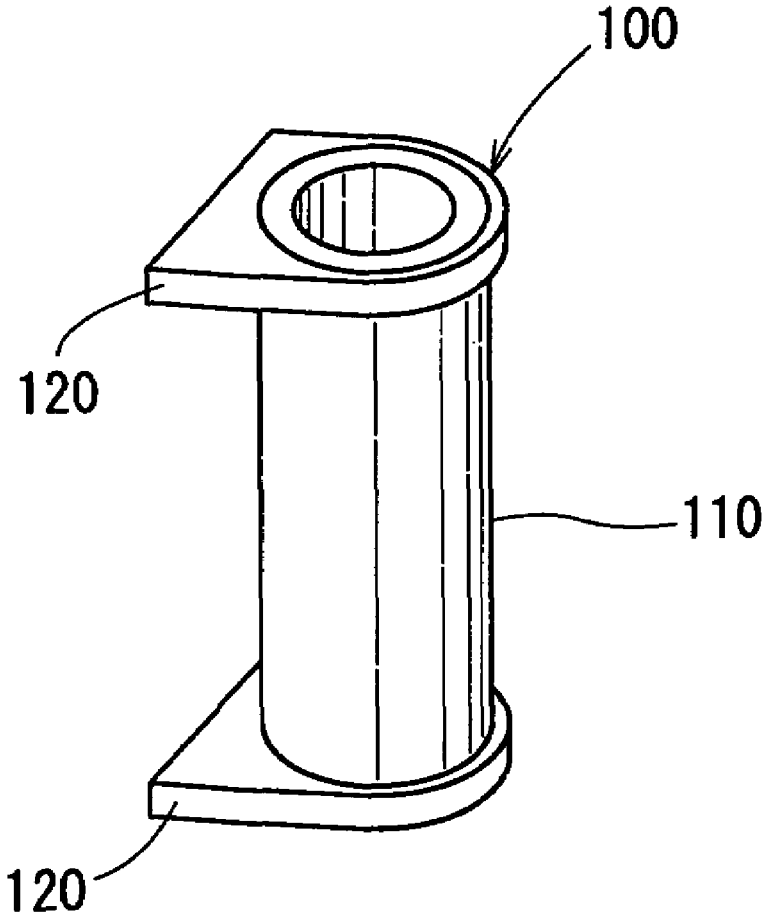
FIG. 3 is a perspective view of a high combustion efficiency device according to a second embodiment of the present invention.
Figure 4:
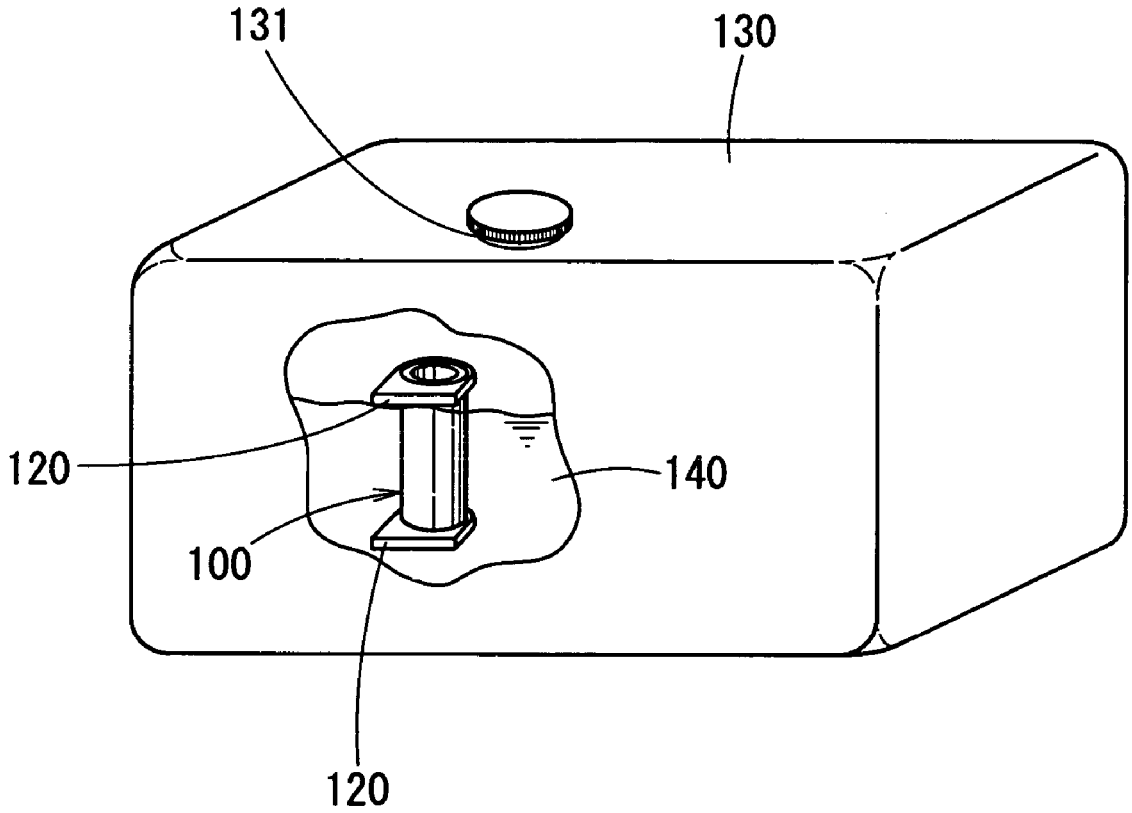
FIG. 4 is a perspective view of a portion of a fuel tank of a truck, showing an example in which the high combustion efficiency device in FIG. 3 is used.
Figure 5:
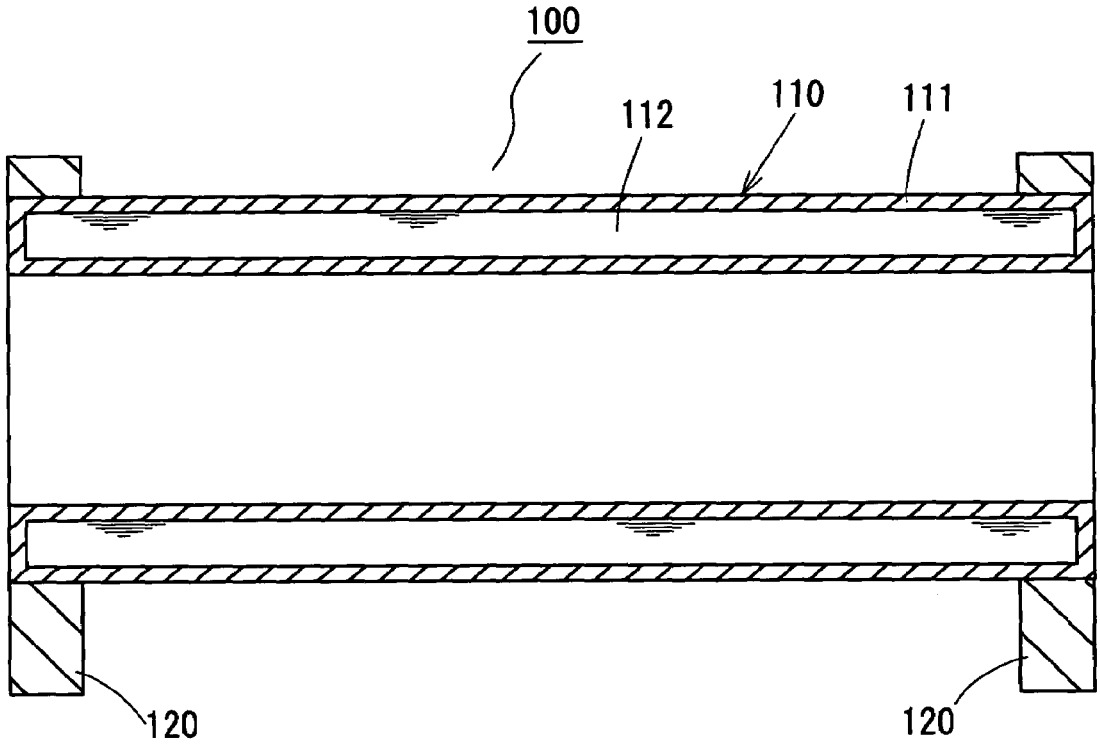
FIG. 5 is a cross sectional view of a device body of the high combustion efficiency device in FIG. 3.

FIG. 3 to FIG. 5 show a high combustion efficiency device for liquid fuel according to a second embodiment of the present invention.

As shown in FIG. 3 and FIG. 4, the high combustion efficiency device 100 includes a device body 110 and permanent magnets 120 as adsorption (attachment) means.

As shown in FIG. 5, the device body 110 is composed of a cylindrical hollow member 111, and electrically conductive solution 112 filled in the hollow member 111.

The hollow member 111 is made of aluminum, and the surface of the hollow member 111 is covered by hard alumite.

Each of the permanent magnets 120 has a substantially horseshoe-shaped contour. The permanent magnets 120 are connected to both sides of the device body 110 to have a saddle shape.

The tourmaline particles and the carbon graphite particles are dispersed in water, in the electrically conductive solution 112.

In use, for example, as shown in FIG. 4, the high combustion efficiency device 100 is inserted into a fuel tank 130 of a truck or the like, from an oil supply port 131 of the fuel tank 130, and the high combustion efficiency device 100 is attached to the inner surface of the fuel tank 130 by the two permanent magnets 120. At this time, the device body 110 is immersed in liquid fuel 140 such as light oil or the like in the fuel tank 130.

That is, the liquid fuel 140 in the fuel tank 130 is affected by the electromagnetic waves such as the far-infrared rays generated by the tourmaline particles filled in the hollow member 111 of the high combustion efficiency device 100 so that the hydrocarbon molecules in the liquid fuel are combusted easily (oxygen can attack easily).

Therefore, the liquid fuel supplied to the engine of a truck or a passenger car is combusted swiftly and completely in the engine 92 in comparison with the case in which the high combustion efficiency device 100 is not mounted. Therefore, the exhaust gas contains almost no CO and HC.

Further, since the gasoline is combusted almost completely in the engine, the exhaust gas is not further combusted in the exhaust pipe. Therefore, temperature in the exhaust pipe is kept at a low level, and it is possible to suppress generation of NOx which is generated easily at high temperatures.

Further, since the surface of the hollow member 111 is covered by hard alumite which is the far-infrared ray generating substance, in comparison with the case in which only the tourmaline particles are used, the amount of far-infrared rays is increased.

Figure 6:
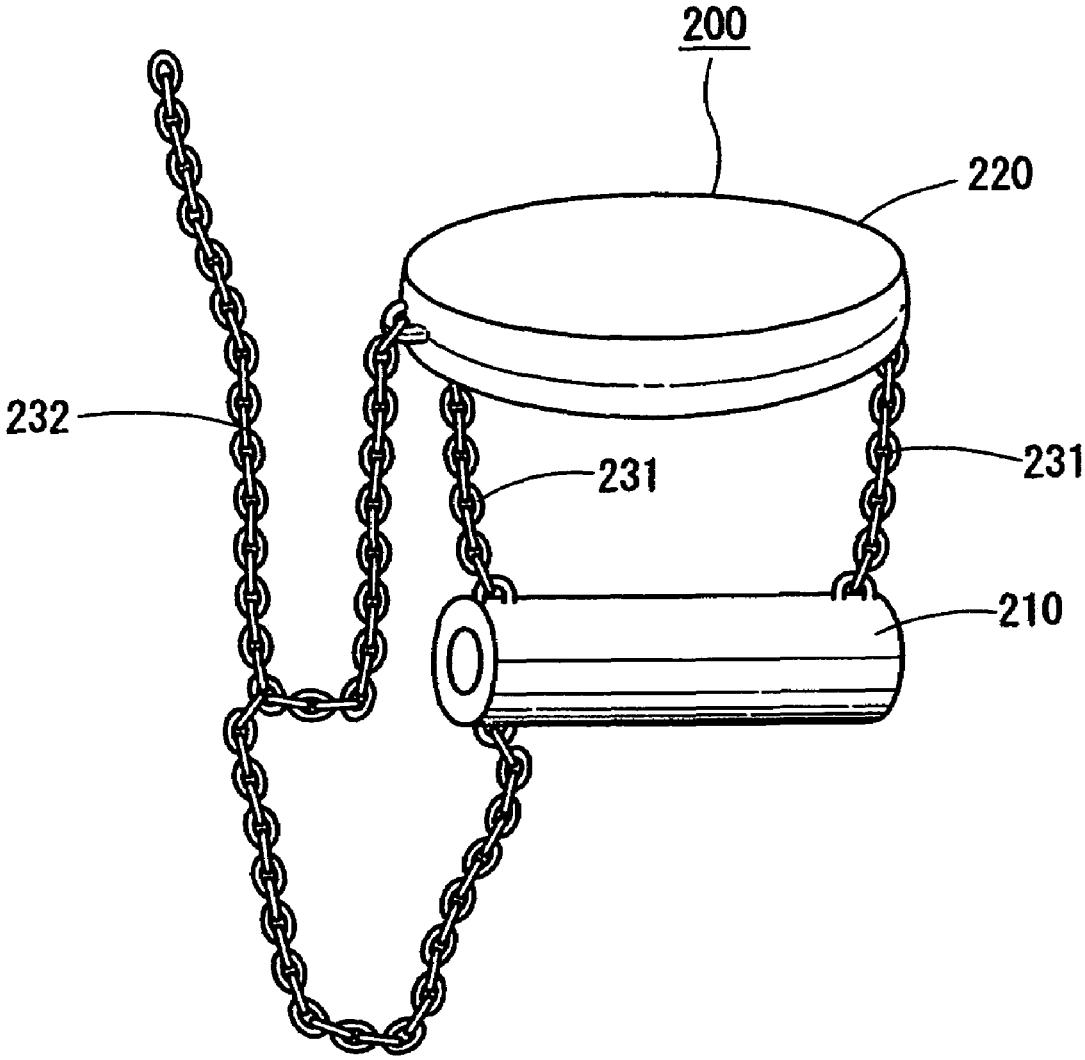
FIG. 6 is a perspective view of a high combustion efficiency device according to a third embodiment of the present invention.
Figure 7:
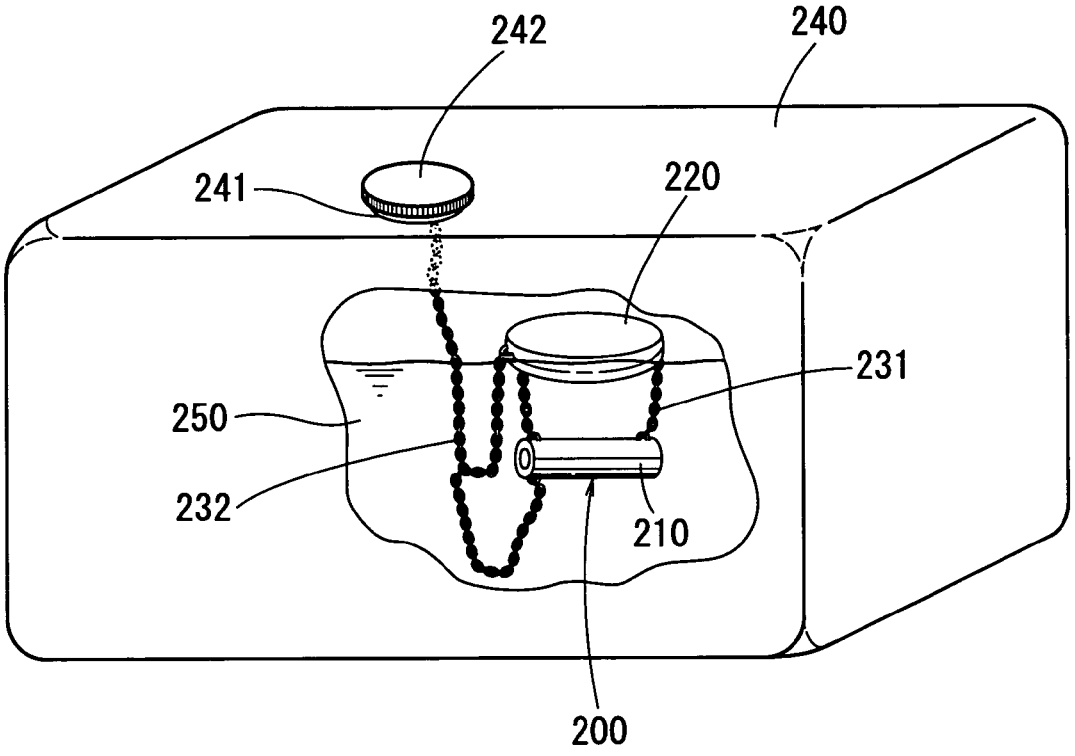
FIG. 7 is a perspective view of a portion of a fuel tank of a truck, showing an example in which the high combustion efficiency device in FIG. 6 is used.

FIG. 6 and FIG. 7 show a high combustion efficiency device for liquid fuel according to a third embodiment of the present invention.

As shown in FIG. 6 and FIG. 7, the high combustion efficiency device 200 includes a device body 210 and a float 220.

Figure 8:
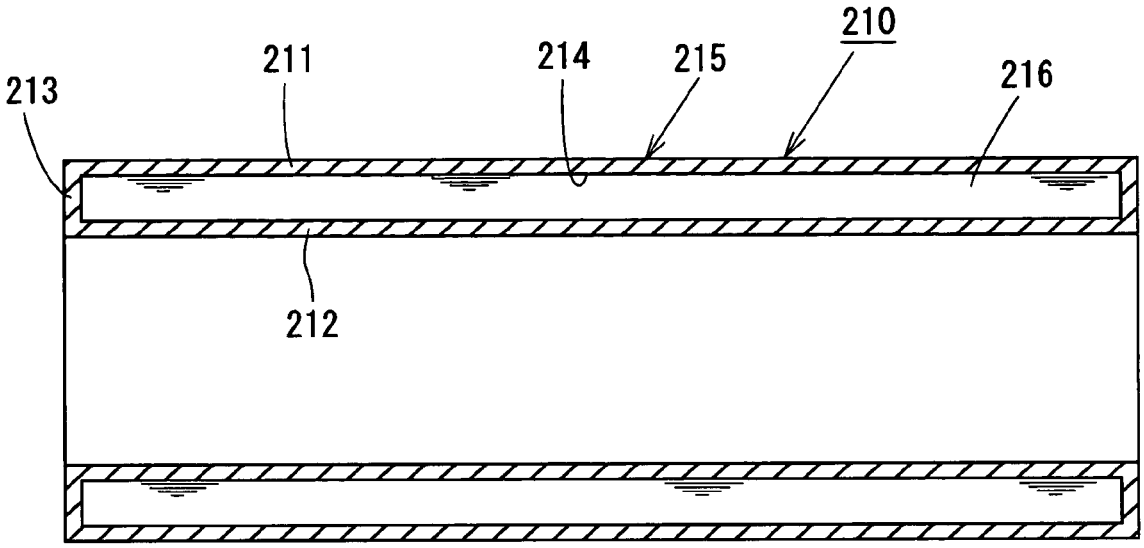
FIG. 8 is a cross sectional view of a device body of the high combustion efficiency device in FIG. 6.

As shown in FIG. 8, the device body 210 is composed of a hollow member 215 and electrically conductive solution 216 filled in the hollow member 215. The hollow member 215 has a dual cylindrical structure including an outer tube 211 and an inner tube 212. Ends of the outer tube 211 and the inner tube 212 are closed by a ring-shaped lid 213. The hollow member 215 has an internal space 214 between the outer tube 211 and the inner tube 212. The electrically conductive solution 216 is filled in the inner space 214.

The hollow member 215 is made of aluminum, and the surface of the hollow member 215 exposed to the outside is covered by hard alumite.

The tourmaline particles and the carbon graphite particles are dispersed in water, in the electrically conductive solution 216.

The float 220 is made of oil resistant synthetic resin such as polyethylene, and has a hollow structure. The float 220 has a disk shape and its cross section is larger than the device body 210.

The device body 210 and the float 220 are connected via two hanging chains 231 such that the device body 210 is hung under the float 220. The device body 210 and the float 220 are supported by a lid 242 of an oil supply port 241 of a fuel tank 240 by a coupling chain 232. One end of the coupling chain 232 is fixed to the lid 242. The coupling chain 232 is branched from the middle. One of the branched ends is fixed to the float 220, and the other of the branched ends is fixed to the device body 210.

As shown in FIG. 7, the high combustion efficiency device 200 is held in place while the device body 210 is caused to float in the liquid fuel 250 in the fuel tank 240 by the float 220.

That is, the liquid fuel 250 in the fuel tank 240 is affected by the electromagnetic waves such as the far-infrared rays generated by the tourmaline particles filled in the hollow member 215 of the high combustion efficiency device 200 so that the hydrocarbon molecules in the liquid fuel 250 are combusted easily (oxygen can attack easily).

The liquid fuel 250 supplied to the engine of a truck or a passenger car is combusted swiftly and completely in the engine in comparison with the case in which the high combustion efficiency device 200 is not mounted. Therefore, the exhaust gas contains almost no CO and HC.

Further, since the liquid fuel is combusted almost completely in the engine, the exhaust gas is not further combusted in the exhaust pipe. Therefore, temperature in the exhaust pipe is kept at a low level, and it is possible to suppress generation of NOx which is generated easily at high temperatures.

Further, since the surface of the hollow member 215 exposed to the outside, i.e., the surface which contacts the liquid fuel 250 is covered by hard alumite which is the far-infrared ray generating substance, in comparison with the case in which only the tourmaline particles are used, the amount of far-infrared rays is increased.

Further, since the device body 210 is floating in the liquid fuel 250 via the float 220, even if the liquid amount of the liquid fuel 250 is decreased, the device body 210 is always immersed in the liquid fuel 250. Thus, the liquid fuel 250 is always placed in the stable high combustion condition.

Further, the device body 21 and the float 220 are fixed to the lid 242 via the coupling chain 232, and the float 220 is larger than the device body 210. Thus, it is possible to prevent the device body 210 from being damaged when the device body 210 hits the inner surface of the fuel tank 240 due to the shaking of the fuel tank 240 or the like.

The liquid fuel 250 which is processed to be combusted highly efficiently using the high combustion efficiency device 200 has a specific gravity higher than that of the unprocessed liquid fuel. Therefore, the liquid fuel which is processed to be combusted highly efficiently near the device body 210 sinks toward the bottom of the fuel tank 240, and the unprocessed liquid fuel floats upwardly. That is, convection of the liquid fuel occurs. By the convection, the unprocessed liquid fuel is supplied to the position near the device body 210. Thus, the whole liquid fuel in the fuel tank is efficiently processed to be combusted highly efficiently.

The present invention is not limited to the above embodiments. In the first embodiment, although the high combustion efficiency device is attached to the fuel pipe of the automobile, for example, the high combustion efficiency device is also applicable to devices which use the liquid fuel such as aircraft, diesel engines, or boilers.

In the first embodiment, the high combustion efficiency device is attached to the fuel pipe. Alternatively, the high combustion efficiency device may be attached to a position around the fuel tank.

In the first embodiment, the ground wire is connected to the minus terminal of the battery. Alternatively, the ground wire may be connected to a body of the automobile or the like.

In the first embodiment, the attachment condition of the high combustion efficiency device body is maintained by the bolt and the nut. Alternatively, a flat fastener (hook and loop fastener), a cord, or a band may be used for tightening. Further, one pair of edges of the two hollow members may be connected together using a hinge, and the other pair of edges of the hollow members may be engaged with a detachable pin or the like using engagement means.

In the first embodiment, the number of hollow members is two. Alternatively, the number of hollow members may be three or more, or one.

In the first embodiment, each of the hollow members has a semi-cylindrical shape. Alternatively, the high combustion efficiency device may have a tubular shape, and a large number of tubular high combustion efficiency devices may be used to surround the fuel pipe 91. Further, the high combustion efficiency device may comprise one tubular hollow member, and the high combustion efficiency device may be attached to the fuel pipe by spirally winding the high combustion efficiency device around the fuel pipe.

In the second embodiment, the permanent magnet has a substantially horseshoe-shape. Alternatively, the permanent magnet may have a regular triangular shape or other shapes.

In the second and third embodiments, the high combustion efficiency device is used for the fuel tank of an automobile, a truck, or the like. Alternatively, the high combustion efficiency device may be used for a fuel storage tank of a gas station.

Next, specific examples of the present invention will be described in detail.

FIRST EXAMPLE

A surface of an aluminum tube having a diameter of 6 mm and a thickness of 0.5 mm was subjected to an anodic oxidation process to form a hard alumite layer having a thickness of 30 μm as a far-infrared ray generating substance.

Then, an electrically conductive solution which is obtained by dispersing and mixing tourmaline particles and carbon graphite particles by 10 weight %, respectively, was filled in the aluminum tube covered by hard alumite. Both ends of the tube were closed to obtain a high combustion efficiency tube having a length of 100 mm.

Ends of nine high combustion efficiency tubes as obtained above were connected by a lead wire so that electricity flows through the hollow member. In this manner, the high combustion efficiency device body was obtained.

The high combustion efficiency device body was used for a Rafaga produced by Honda Motor Co., Ltd. The high combustion efficiency device was wound around a fuel pipe as a fuel passage such that the nine tubes surround the fuel pipe. Further, a far-infrared ray reflection sheet (ECOSHADE produced by Mitsubishi Material Corporation) as a far-infrared ray reflection layer was wound around the high combustion efficiency device body. Thereafter, a band was used to tightly attach the high combustion efficiency device around the fuel pipe. Further, a ground wire connected to a lead wire was connected to a minus terminal of a battery.

Then, the engine was started. When the engine sound was stabilized, CO, $CO_2$, $O_2$, HC, and NOx in the exhaust gas at the time of idling (730 rpm) and at the time of idling away of the engine were measured using a gas concentration measurement device (Dicom 4000 produced by AVL Corporation). The results are shown in a Table 1 together with measurement results in the case in which the high combustion efficiency device is not mounted.

SECOND EXAMPLE

The Second Example was carried out in the same manner as with the First Example except that the high combustion efficiency device is attached to the fuel pipe of a Step Wagon produced by Honda Motor Co., Ltd. The engine was started, and when the engine sound was stabilized, CO, $CO_2$, $O_2$, HC, and NOx in the exhaust gas at the time of idling (730 rpm) and at the time of idling away of the engine were measured using the gas concentration measurement device (Dicom 4000 produced by AVL Corporation). The results are shown in a Table 2 together with measurement results in the case in which the high combustion efficiency device is not mounted.

As can be seen from the Tables 1 and 2, with the use of the high combustion efficiency device according to the present invention, the amounts of CO and HC in the exhaust gas are significantly reduced, and the combustion efficiency is improved in comparison to the case in which the high combustion efficiency device is not used. Further, as can been seen from Table 1, the amount of NOx is also reduced.

THIRD EXAMPLE

Four high combustion efficiency devices used in the First Example were placed in 15 liters of unprocessed gasoline in a polytank. The gasoline was stirred, and left for five minutes to obtain the processed gasoline.

The specific gravity of the obtained processed gasoline and the specific gravity of the unprocessed gasoline were measured. The processed gasoline and the unprocessed gasoline were individually filled in a fuel tank of a Step Wagon produced by Honda Motors Co., Ltd. The high combustion efficiency device according to the present invention is not mounted on the Step Wagon. In each of the cases, the engine was started, and CO, $CO_2$, $O_2$, HC, and NOx in the exhaust gas at the time of idling (730 rpm) and at the time of idling away of the engine were measured using the gas concentration measurement device (Dicom 4000 produced by AVL Corporation). The results are shown in a Table 3.

As can be seen from Table 3, when the high combustion efficiency device according to the present invention directly contacts the liquid fuel, it is also possible to improve the combustion efficiency of the liquid, and the density of the liquid fuel is increased by processing the liquid fuel.

TABLE 1

| | MOUNTED | | | UNMOUNTED | |
|---|---|---|---|---|---|
| | REVOLUTIONS(rpm) | | | | |
| | 710 | 2440 | 2400 | 710 | 2550 |
| λ (air-fuel ratio) | 1.001 | 1.000 | 1.000 | 1.011 | 1.003 |
| CO (vol %) | 0.01 | 0.10 | 0.04 | 0.25 | 0.28 |
| $CO_2$ (vol %) | 15.5 | 15.4 | 15.5 | 15.0 | 15.3 |
| $O_2$ (vol %) | 0.07 | 0.09 | 0.04 | 0.52 | 0.29 |
| HC (ppm) | 33 | 25 | 12 | 125 | 48 |
| Nox (ppm) | 2 | 27 | 14 | 119 | 154 |

TABLE 2

| | MOUNTED | | UNMOUNTED |
|---|---|---|---|
| REVOLUTIONS(rpm) | 730 | 2540 | 730 |
| λ (air-fuel ratio) | 1.04 | 1.000 | 1.017 |
| CO (vol %) | 0.00 | 0.10 | 0.55 |
| $CO_2$ (vol %) | 15.4 | 15.5 | 14.2 |
| $O_2$ (vol %) | 0.09 | 0.09 | 0.91 |
| HC (ppm) | 36 | 29 | 252 |

TABLE 3

| | PROCESSED GASOLINE | | UNPROCESSED GASOLINE | |
|---|---|---|---|---|
| SPECIFIC GRAVITY | 0.722 | | 0.720 | |
| REVOLUTIONS(rpm) | 730 | 2540 | 730 | 2540 |
| λ (air-fuel ratio) | 1.002 | 1.000 | 1.006 | 1.002 |
| CO (vol %) | 0.01 | 0.11 | 0.10 | 0.22 |
| $CO_2$ (vol %) | 15.5 | 15.4 | 15.1 | 15.2 |
| $O_2$ (vol %) | 0.05 | 0.04 | 0.43 | 0.25 |
| HC (ppm) | 25 | 18 | 110 | 44 |

What is claimed is:

1. A high combustion efficiency device for liquid fuel, comprising:

a hollow member made of electrically conductive material;

liquid filling the hollow member; and tourmaline particles dispersed in the liquid;

wherein the liquid comprises an electrically conductive solution or electrically conductive gel containing carbon graphite particles.

2. The high combustion efficiency device according to claim 1, wherein the high combustion efficiency device is formed to be attachable to at least one of a fuel tank of liquid fuel and a fuel passage extending from the fuel tank to a combustion device of the liquid fuel.

3. The high combustion efficiency device according to claim 1, wherein the high combustion efficiency device is arranged to surround a fuel pipe extending from a fuel tank to a combustion device of the liquid fuel.

4. The high combustion efficiency device according to claim 3, wherein a surface of the hollow member is covered by a far-infrared ray generating substance.

5. The high combustion efficiency device according to claim 4, wherein the far-infrared ray generating substance is hard alumite.

6. The high combustion efficiency device according to claim 4, wherein the far-infrared ray generating substance is provided as an outermost layer.

7. The high combustion efficiency device according to claim 4, wherein the high efficiency combustion device is mounted while the hollow member is grounded.

8. The high combustion efficiency device according to claim 1, wherein a surface of the hollow member is covered by a far-infrared ray generating substance.

9. The high combustion efficiency device according to claim 8, wherein the far-infrared ray generating substance is hard alumite.

10. The high combustion efficiency device according to claim 8, wherein the far-infrared ray generating substance is provided as an outermost layer.

11. The high combustion efficiency device according to claim 1, further comprising attachment means attached to an inner wall surface of a fuel tank.

12. The high combustion efficiency device according to claim 1, wherein the hollow member and the liquid constitute a device body; and a float is provided which allows the device body to float in the fuel in a fuel tank.

13. The high combustion efficiency device according to claim 1, wherein the high efficiency combustion device is mounted while the hollow member is grounded.

14. The high combustion efficiency device according to claim 3, wherein the high efficiency combustion device is mounted while the hollow member is grounded.

15. The high combustion efficiency device according to claim 1, further comprising a permanent magnet secured to the hollow member for attaching the hollow member to an inner wall surface of a fuel tank.

16. The high combustion efficiency device according to claim 1, wherein said high efficiency combustion device is configured to be mounted to a fuel system member, in a manner so as to influence the liquid fuel, while the hollow member is grounded.

17. A high combustion efficiency device for liquid fuel, comprising:

a hollow member made of electrically conductive material;

liquid filling the hollow member; and tourmaline particles dispersed in the liquid;

wherein the high efficiency combustion device is mounted while the hollow member is grounded; and wherein the high combustion efficiency device is arranged to surround a fuel pipe extending from a fuel tank to a combustion device of the liquid fuel.

18. A high combustion efficiency device for liquid fuel, comprising:

a hollow member made of electrically conductive material;

liquid filling the hollow member; and tourmaline particles dispersed in the liquid;

wherein the high efficiency combustion device is mounted while the hollow member is grounded; and wherein a surface of the hollow member is covered by a far-infrared ray generating substance.

19. The high combustion efficiency device according to claim 18, wherein the far-infrared ray generating substance is hard alumite.

20. The high combustion efficiency device according to claim 18, wherein the far-infrared ray generating substance is provided as an outermost layer.

21. A high combustion efficiency device for liquid fuel, comprising:

a hollow member made of electrically conductive material;

liquid filling the hollow member; and tourmaline particles dispersed in the liquid;

wherein the high efficiency combustion device is mounted while the hollow member is grounded;

wherein the hollow member and the liquid constitute a device body; and wherein a float is provided which allows the device body to float in the fuel in a fuel tank.

22. A high combustion efficiency device for liquid fuel, comprising:

a hollow member made of electrically conductive material;

liquid filling the hollow member; and tourmaline particles and carbon graphite particles dispersed in the liquid;

wherein the high efficiency combustion device is configured to be mounted to a fuel system member, in a manner so as to influence the liquid fuel while the hollow member is grounded.

23. The high combustion efficiency device according to claim 22, further comprising attachment means attached to an inner wall surface of a fuel tank.

24. The high combustion efficiency device according to claim 22, wherein the high combustion efficiency device is formed to be attachable to at least one of a fuel tank of liquid fuel and a fuel passage extending from the fuel tank to a combustion device of the liquid fuel.

25. The high combustion efficiency device according to claim 22, wherein said high efficiency combustion device is configured to be mounted to a fuel system member, in a manner so as to influence the liquid fuel.

26. A high combustion efficiency device for liquid fuel, comprising:

a hollow member made of electrically conductive material;

liquid filling the hollow member; and tourmaline particles dispersed in the liquid;

wherein the high efficiency combustion device is mounted while the hollow member is grounded;

wherein a permanent magnet is secured to the hollow member for attaching the hollow member to an inner wall surface of a fuel tank.

* * * * *